US009267655B2

(12) United States Patent
Tanaka et al.

(10) Patent No.: US 9,267,655 B2
(45) Date of Patent: Feb. 23, 2016

(54) VEHICLE LAMP

(75) Inventors: Hidetada Tanaka, Shizuoka (JP); Takashi Inoue, Shizuoka (JP); Takayuki Yagi, Shizuoka (JP); Ken Kato, Shizuoka (JP); Tsukasa Tokida, Shizuoka (JP); Hidemichi Sone, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 575 days.

(21) Appl. No.: 13/459,485

(22) Filed: Apr. 30, 2012

(65) Prior Publication Data

US 2012/0287658 A1 Nov. 15, 2012

(30) Foreign Application Priority Data

May 12, 2011 (JP) ..... 2011-107265

(51) Int. Cl.
*F21S 8/10* (2006.01)

(52) U.S. Cl.
CPC ..... *F21S 48/1305* (2013.01); *F21S 48/1109* (2013.01); *F21S 48/1154* (2013.01); *F21S 48/1159* (2013.01); *F21S 48/325* (2013.01)

(58) Field of Classification Search
CPC ..... F21V 17/02; F21W 2131/103; F21Y 2101/02; F21K 9/10; H01L 2924/0002; H01L 2924/00; H01L 21/768; H01L 23/5226; H01L 23/5283; F21S 48/1305; F21S 48/1159; F21S 48/1109; F21S 48/1154; F21S 48/325
USPC ..... 362/516, 351, 475, 487, 498, 499, 505, 362/506, 538, 539, 540, 541, 542, 543, 545
See application file for complete search history.

(56) References Cited

U.S. PATENT DOCUMENTS

2005/0180156 A1* 8/2005 Iwasaki ..... 362/538
2011/0068687 A1* 3/2011 Takahasi et al. ..... 315/35

FOREIGN PATENT DOCUMENTS

| | | | |
|---|---|---|---|
| JP | 2005-209536 | A | 8/2005 |
| JP | 2006-066108 | A | 3/2006 |
| JP | 2007-134340 | A | 5/2007 |
| JP | 2009-146841 | A | 7/2009 |
| JP | 2010-198955 | A | 9/2010 |
| JP | 2010192139 | A | 9/2010 |
| JP | 2012-003999 | A | 1/2012 |

OTHER PUBLICATIONS

Office Action dated Oct. 28, 2014, issued by the Japanese Patent Office in counterpart Japanese Application No. 2011-107265.
Office Action dated Jan. 27, 2015 issued by Japanese Patent Office in counterpart Japanese Application No. 2011-107265.

* cited by examiner

*Primary Examiner* — Stephen F Husar
*Assistant Examiner* — Danielle Allen
(74) *Attorney, Agent, or Firm* — Sughrue Mion, PLLC

(57) ABSTRACT

A vehicle lamp includes: an LED mount on which an LED is placed; an attachment that fixes the LED to the LED mount; a power supply that supplies power to the LED; a first optical member that controls light emitted from the LED; and a second optical member that controls light emitted from the first optical member. The power supply and the first optical member are provided at the attachment.

10 Claims, 6 Drawing Sheets

VEHICLE LAMP

CROSS REFERENCE TO RELATED APPLICATION(S)

The present disclosure relates to the subject matters contained in Japanese Patent Application No. 2011-107265 filed on May 12, 2011, which are incorporated herein by reference in its entirety.

FIELD

The invention relates to a vehicle lamp, and more particularly, to a vehicle lamp using a Light Emitting Diode (LED).

BACKGROUND

A vehicle lamp, which uses an LED as a light source, has been known for some time. For example, a vehicle lamp where an LED is fixed using a resin-molded component called an attachment is disclosed in JP-A-2010-192139.

The above-mentioned vehicle lamp includes a plurality of components, such as an LED, an attachment on which the LED is mounted, a reflector, and a projection lens. In order to obtain an inexpensive vehicle lamp, it is preferable that the number of components be as small as possible.

SUMMARY

The invention has been made in consideration of the above-mentioned circumstances, and an object of the invention is to provide a vehicle lamp in which the number of components can be reduced.

In order to achieve the object, according to an aspect of the invention, there is provided a vehicle lamp. The vehicle lamp includes an LED mount on which an LED is placed, an attachment that fixes the LED to the LED mount, a power supply that supplies power to the LED, a first optical member that controls light emitted from the LED, and a second optical member that controls light emitted from the first optical member. The power supply and the first optical member are provided at the attachment.

According to this aspect, the power supply, the first optical member, and the attachment are formed integrally with each other as a single piece. Accordingly, the number of components is reduced, so that it is possible to obtain an inexpensive vehicle lamp.

The first optical member may be a reflector that reflects light emitted from the LED so as to direct the light to the second optical member, and the reflector and the attachment may be molded integrally with each other as a single piece.

The vehicle lamp may further include a shade that blocks a part of light from the reflector; and the reflector, the attachment, and the shade may be molded integrally with each other as a single piece.

The first optical member may be a reflector that reflects light emitted from the LED so as to direct the light to the second optical member, and the power supply and the reflector may be formed integrally with each other as a single piece.

The first optical member may be a reflector that reflects light emitted from the LED so as to direct the light to the second optical member, the attachment may include a pushing member that pushes the LED against the LED mount, and the pushing member and the reflector may be formed integrally with each other as a single piece.

According to the exemplary embodiments of the invention, it is possible to provide a vehicle lamp in which the number of components can be reduced.

BRIEF DESCRIPTION OF THE DRAWINGS

A general configuration that implements the various features of the invention will be described with reference to the drawings. The drawings and the associated descriptions are provided to illustrate exemplary embodiments of the invention and should not limit the scope of the invention.

DETAILED DESCRIPTION OF THE EXEMPLARY EMBODIMENTS

Exemplary embodiments of the invention will be described in detail below with reference to the drawings.

Figure 1:
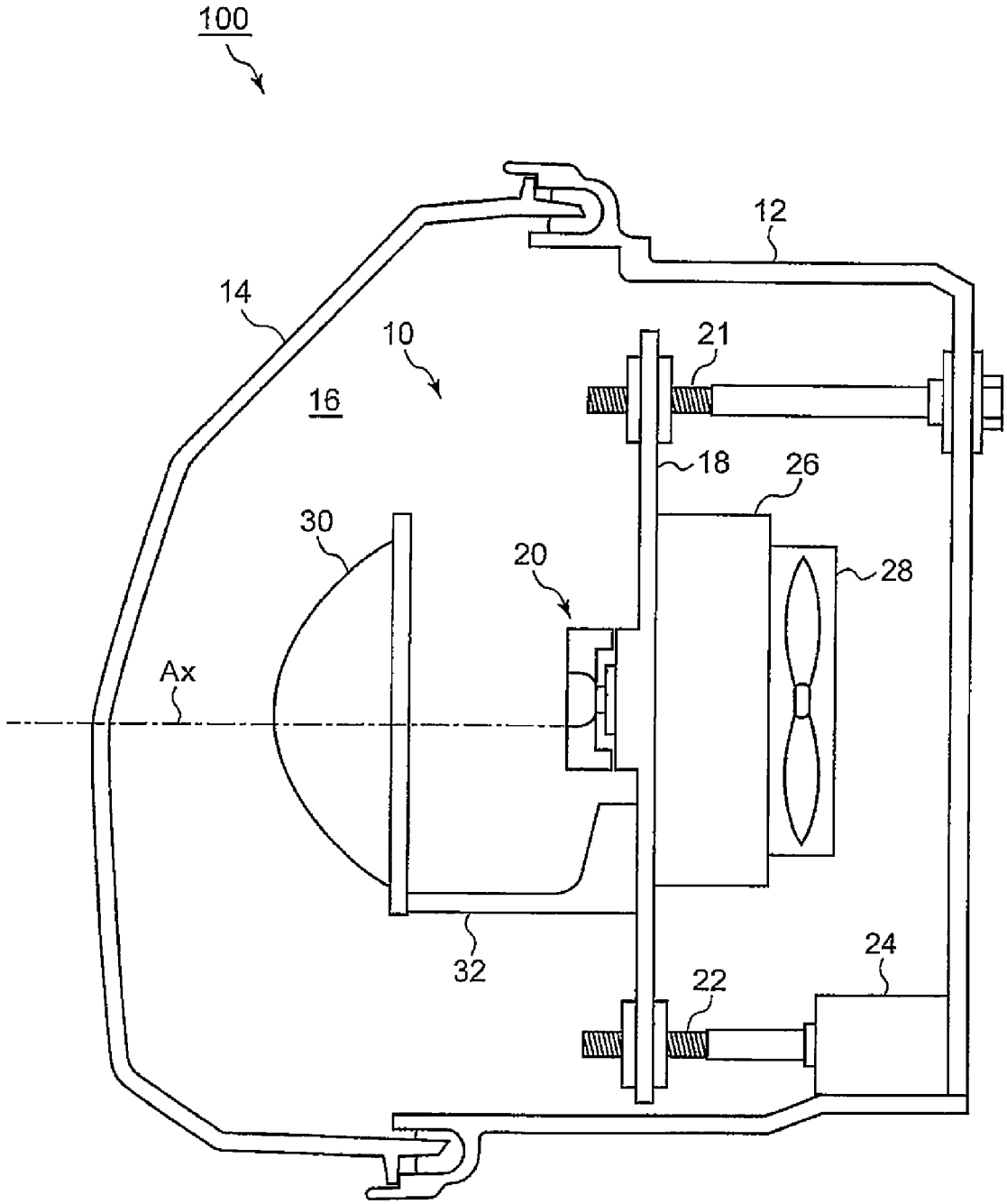
FIG. 1 is a cross-sectional view of a vehicle lamp according to an exemplary embodiment of the invention.

FIG. 1 is a cross-sectional view of a vehicle lamp according to an exemplary embodiment of the invention. A vehicle lamp 100 is a so-called projector type vehicle headlight including a projection lens.

As shown in FIG. 1, the vehicle lamp 100 includes a lamp body 12 that includes a recess that is opened toward the front of the lamp and a cover 14 that closes the opened side of the lamp body 12. An inner space formed by the lamp body 12 and the cover 14 is formed as a lamp chamber 16.

A lamp unit 10 is disposed in the lamp chamber 16. As shown in FIG. 1, the lamp unit 10 is mounted at the substantially central portion of a bracket 18 that is made of metal such as aluminum. A first aiming screw 21 is mounted on the upper portion of the bracket 18, and a second aiming screw 22 is mounted on the lower portion of the bracket 18. The bracket 18 is supported on the lamp body 12 so as to be capable of being tilted by the first and second aiming screws 21 and 22. An aiming actuator 24 is provided at the second aiming screw 22 that is mounted on the lower side. Further, when the aiming actuator 24 is driven, the lamp unit 10 is tilted with the tilt of the bracket 18. Accordingly, the adjustment of the optical axis (aiming adjustment) of illumination light is performed.

The lamp unit 10 includes an LED module 20, a projection lens 30, a lens support 32, a heat sink 26, and a fan 28.

The LED module 20 is provided on the front surface of the bracket 18. The LED module 20 includes a white LED, and emits white light toward the projection lens 30. The detailed structure of the LED module 20 will be described below.

The projection lens 30 projects light, which is emitted from the LED module 20, forward. The projection lens 30 is a plano-convex aspheric lens of which the incident surface is a flat surface and the emission surface is a convex surface. The projection lens 30 is supported in front of the LED module 20 by the lens support 32. An optical axis Ax of the projection lens 30 is substantially parallel to the longitudinal direction of a vehicle.

The heat sink 26 is provided on the back side of the bracket 18. The heat sink 26 is made of metal having high thermal conductivity such as aluminum, and dissipates heat generated from the LED module 20. The fan 28 is provided at the rear of the heat sink 26 and forcibly cools the heat sink 26 with air.

Figure 2:
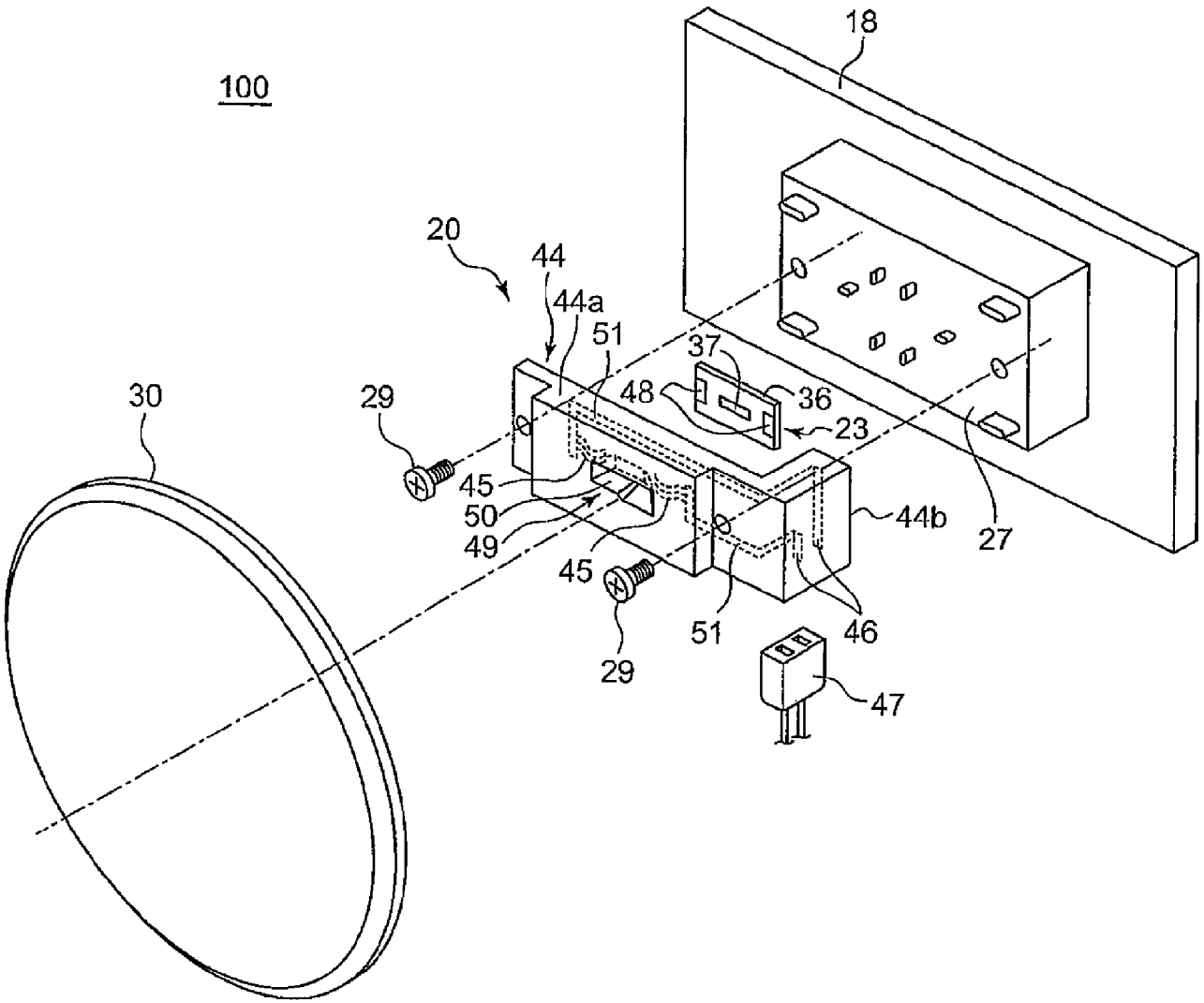
FIG. 2 is an exploded perspective view of an LED module according to an exemplary embodiment of the invention.

FIG. 2 is an exploded perspective view of the LED module according to the exemplary embodiment of the invention. As shown in FIG. 2, the LED module 20 has a structure where an LED package 23 is placed on a substantially central portion of an LED mounting portion 27 molded integrally as a single piece with the bracket 18 by aluminum die casting and an attachment 44 fixing the LED package 23 to the LED mounting portion 27 is provided above the LED package. The attachment 44 is fixed to the LED mounting portion 27 by screws 29.

The LED package 23 includes an LED board 36 and an LED 37. The LED 37 is a white LED having a rectangular light emitting surface. The LED 37 has a structure where four square blue LED chips having a size of about 1 $mm^2$ are arranged in a line on the LED board 36 and a phosphor layer is provided on the LED chips. The phosphor layer is a layer that is obtained by converting a yellow phosphor, which converts blue light into yellow light, into a ceramic in the form of a rectangular plate. Alternatively, the phosphor layer may be formed by sealing the yellow phosphor in glass. When the blue LED chips emit light, blue light having passed through the phosphor layer and yellow light converted by the phosphor layer are mixed with each other. Accordingly, white light is obtained.

The LED board 36 is made of aluminum nitride or the like, and supplies current to the LED 37. Sheet electrodes 48 are provided on both the left and right ends of the LED board 36.

The attachment 44 is a resin-molded component that is molded in an L-shape, and includes a first base portion 44*a* and a second base portion 44*b*.

A reflector 49, which controls the light emitted from the LED 37, is formed at a substantially central portion of the first base portion 44*a*. The reflector 49 has a function of reflecting light, which is emitted from the LED 37, so as to direct the light to the projection lens 30. An opening portion 50 is formed at a substantially central portion of the first base portion 44*a* and a light reflective material is applied to the inner wall surface of the opening portion 50, so that the reflector 49 is formed. Four reflective surfaces having a parabolic cross-section are formed on the inner wall surface of the opening portion 50. The shape and size of the opening of the opening portion 50 facing the LED package 23 are substantially the same as the shape and size of the light emitting surface of the LED 37. Meanwhile, the opening of the opening portion 50 facing the projection lens 30 is formed in a shape corresponding to a low-beam light distribution pattern having a predetermined cut-off line. In other words, the opening of the opening portion 50 facing the projection lens 30 is formed in the inverted shape of the low-beam light distribution pattern. Accordingly, an image of the light reflected from the reflector 49 has the inverted shape of the low-beam light distribution pattern. The inverted image of this image is projected by the projection lens 30, so that the low-beam light distribution pattern is emitted.

Further, two spring terminals 45 are provided on the side of the first base portion 44*a* facing the LED package 23. When the attachment 44 is provided above the LED package 23, the spring terminals 45 are electrically connected to the sheet electrodes 48 of the LED board 36. Accordingly, power is supplied to the LED 37. Further, the spring terminals 45 push the LED package 23 against the LED mounting portion 27, and the LED package 23 is fixed on the LED mounting portion 27 by this pushing force.

One end portions of conductive parts 51, which are embedded in the first and second base portions 44*a* and 44*b* of the attachment 44, are connected to the spring terminals 45. The conductive parts 51 extend from the first base portion 44*a* to the second base portion 44*b*, and the other end portions of the conductive parts 51 form connector terminals 46. In FIG. 2, the conductive parts 51 embedded in the attachment 44 are shown by a broken line. A power supply connector 47 is connected to the connector terminals 46. The spring terminals 45, the conductive parts 51, and the connector terminals 46 form a power supply unit that supplies power to the LED 37.

As described above, in this exemplary embodiment, the attachment 44, which fixes the LED 37 to the LED mounting portion 27, is provided with the reflector 49 that controls light emitted from the LED 37 so as to direct the light to the projection lens 30 and the power supply unit that supplies power to the LED 37. That is, the attachment 44, the reflector 49, and the power supply unit are integrated with each other as a single piece. Accordingly, since it is possible to reduce the number of components, it is possible to obtain an inexpensive vehicle lamp.

Further, if a small reflector 49 is provided in the immediate vicinity of the LED 37 as in this exemplary embodiment, it is possible to efficiently make light, which is emitted from the LED 37, enter the projection lens 30 by suitably controlling the traveling direction of the light emitted from the LED 37. That is, it is possible to improve the light use efficiency.

Figure 3:
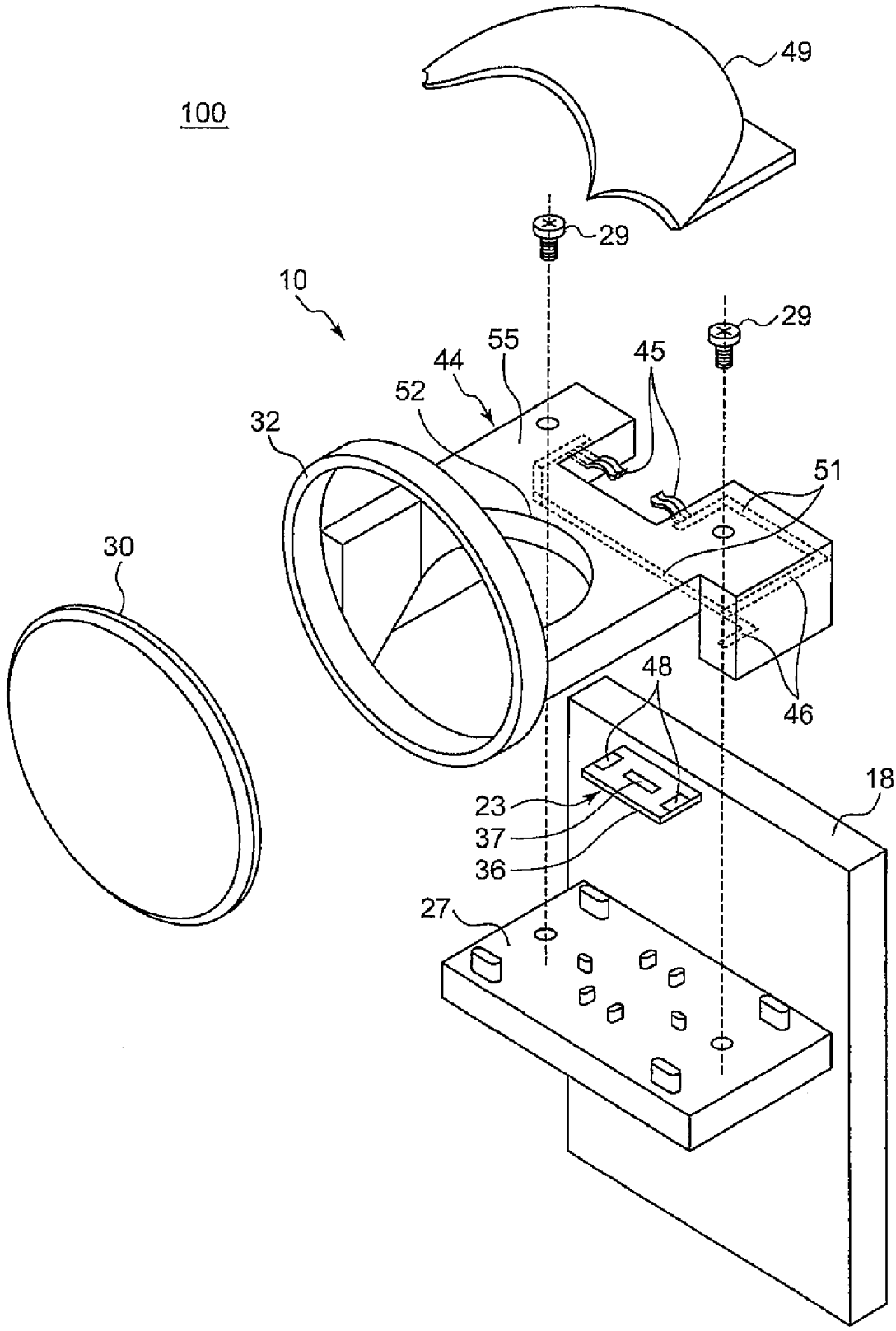
FIG. 3 is an exploded perspective view of main parts of a vehicle lamp according to another exemplary embodiment of the invention.

FIG. 3 is an exploded perspective view of main parts of a vehicle lamp according to another exemplary embodiment of the invention. Meanwhile, in the following exemplary embodiment, the same elements as the elements of the vehicle lamp shown in FIGS. 1 and 2 or the elements corresponding to the elements of the vehicle lamp shown in FIGS. 1 and 2 are denoted by the same reference numerals and repeated description thereof will be appropriately omitted.

As shown in FIG. 3, a lamp unit 10 of a vehicle lamp 100 according to this exemplary embodiment includes an LED package 23, an LED mounting portion 27, an attachment 44 that fixes the LED package 23 to the LED mounting portion 27, a reflector 49 that reflects light emitted from an LED 37 to the front of the lamp, and a projection lens 30.

In this exemplary embodiment, the LED package 23 is placed on the LED mounting portion 27 so that the light emission surface of the LED 37 faces upward. An attachment 44 is provided above the LED package 23. The attachment 44 is fixed to the LED mounting portion 27 by screws 29.

Spring terminals 45 are provided on the side (lower surface side) of a base portion 55 of the attachment 44 facing the LED package 23. When the attachment 44 is provided above the LED package 23, the spring terminals 45 are electrically connected to sheet electrodes 48 of the LED board 36. Accordingly, power is supplied to the LED 37. Further, the LED package 23 is fixed on the LED mounting portion 27 by the pushing force of the spring terminals 45. Conductive parts 51, which connect the spring terminals 45 to connector terminals 46, are embedded in the base portion 55.

Furthermore, the base portion 55 is provided with the reflector 49 that reflects light emitted from the LED 37 to the front of the lamp. In this exemplary embodiment, the reflector 49 is formed so that the vertical cross-section of the reflector has a substantially oval shape and the horizontal cross-section of the reflector has a free curved surface shape based on an oval shape. The reflector 49 is disposed so that a first focus of the reflector is near a light emitting portion of the LED 37. Meanwhile, the base portion 55 and the reflector 49 are shown in FIG. 3 while being separated from each other. However, the base portion 55 and the reflector 49 may be formed integrally with each other using a resin.

Moreover, a shade 52, which forms an inverted image of a low-beam light distribution pattern by blocking a part of the light reflected by the reflector 49, is formed at the side (upper surface side) of the base portion 55 facing the reflector 49. The shade 52 is formed so as to be positioned near a second focus of the reflector 49.

Further, a lens support 32, which supports the projection lens 30, is formed at the front end portions of the base portion 55. The rear focus of the projection lens 30, which is supported by the lens support 32, substantially corresponds to the second focus of the reflector 49. The projection lens 30 projects an inverted image of an image formed on the rear focal plane, that is, a low-beam light distribution pattern to the front of the vehicle lamp 100.

As described above, in this exemplary embodiment, the attachment 44, which fixes the LED 37 to the LED mounting portion 27, is provided with the power supply unit that supplies power to the LED 37, the reflector 49 that reflects the light emitted from the LED 37 to the front of the lamp, the shade 52 that blocks a part of the light reflected by the reflector 49, and the lens support 32 that supports the projection lens 30. That is, the attachment 44, the power supply unit, the reflector 49, the shade 52, and the lens support 32 are integrated with each other as a single piece. Accordingly, since it is possible to reduce the number of components, it is possible to obtain an inexpensive vehicle lamp.

Furthermore, according to this exemplary embodiment, the reflector 49, the shade 52, and the lens support 32 are integrated with each other as a single piece. Accordingly, aligning of these components is not needed. This results in the reduction of the manufacturing costs.

Figure 4:
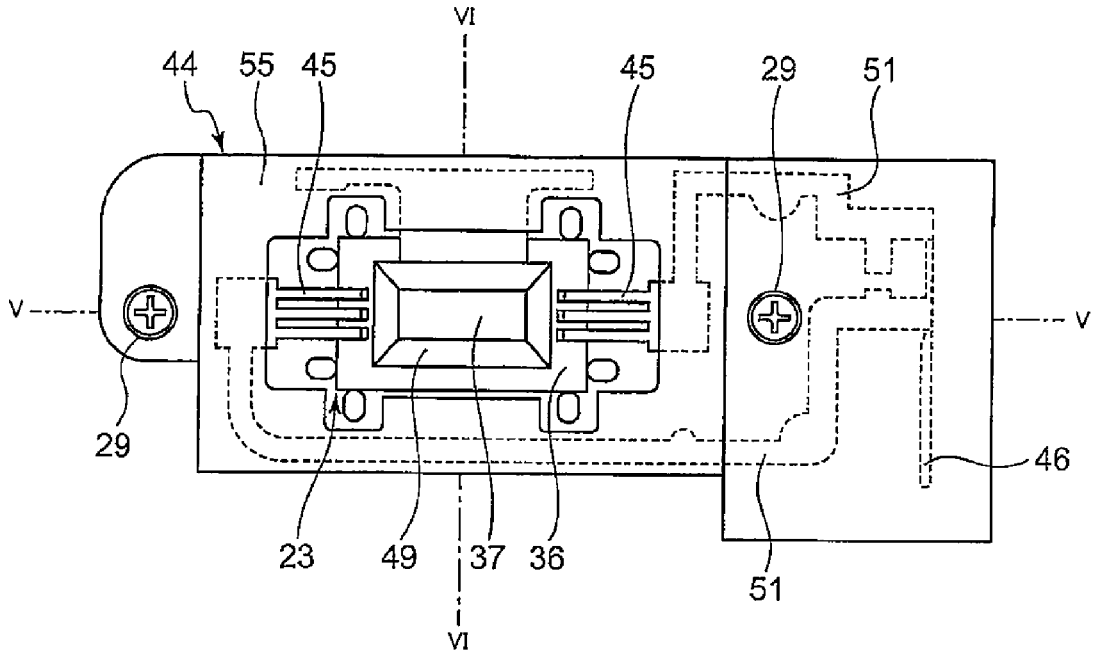
FIG. 4 is a plan view of main parts of a vehicle lamp according to still another exemplary embodiment of the invention.
Figure 5:
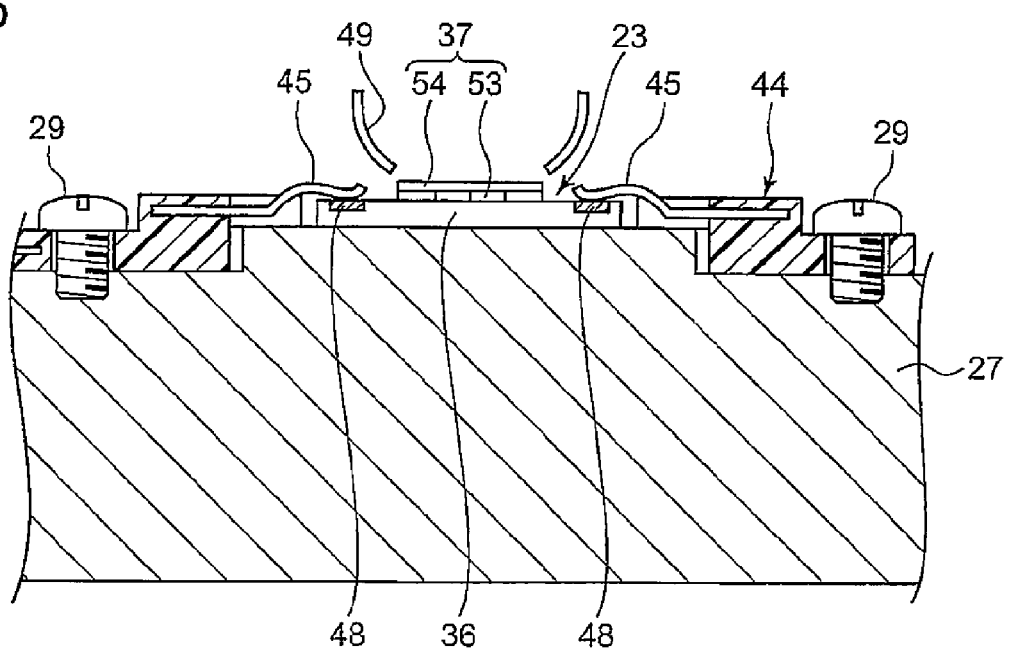
FIG. 5 is a cross-sectional view of the vehicle lamp shown in FIG. 4 taken along line V-V.
Figure 6:
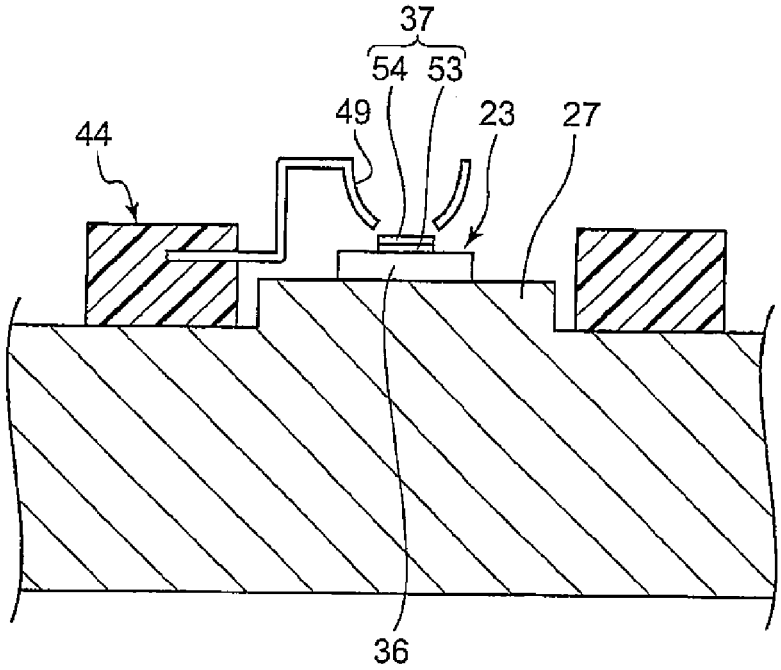
FIG. 6 is a cross-sectional view of the vehicle lamp shown in FIG. 4 taken along line VI-VI.

FIG. 4 is a plan view of main parts of a vehicle lamp according to still another exemplary embodiment of the invention. Further, FIG. 5 is a cross-sectional view of the vehicle lamp shown in FIG. 4 taken along line V-V. Furthermore, FIG. 6 is a cross-sectional view of the vehicle lamp shown in FIG. 4 taken along line VI-VI. FIGS. 4 to 6 show the peripheral portion of an attachment 44. The attachment 44 according to this exemplary embodiment may be replaced by the attachment of the vehicle lamp shown in FIG. 1.

As shown in FIGS. 4 to 6, an LED package 23 is mounted on an LED mounting portion 27. The LED package 23 includes four blue LED chips 53 that are arranged in a line on the LED board 36, and a phosphor layer 54 that is provided on the light emitting surfaces of the blue LED chips 53. Sheet electrodes 48 provided on the LED board 36 are pressed by spring terminals 45 made of metal, so that the LED package 23 is fixed on the LED mounting portion 27.

Moreover, reflectors 49, which reflect light emitted from an LED 37 so as to direct the light to a projection lens (not shown: see FIG. 1), are provided above the LED package 23. In this exemplary embodiment, the reflectors 49 are formed of metal plates.

Here, in this exemplary embodiment, the power supply unit that includes the spring terminals 45, the conductive parts 51, and the connector terminals 46, and the reflectors 49 are formed of metal plates. Metal plates are subjected to pressing after insert molding, so that the power supply unit and the reflectors 49 are formed. The conductive parts 51 of the power supply unit and supports of the reflectors 49 are embedded in the base portion 55 of the attachment 44 made of a resin. That is, in this exemplary embodiment, the attachment, the power supply unit, and the reflectors 49 are formed integrally with each other. Accordingly, since it is possible to reduce the number of components, it is possible to obtain an inexpensive vehicle lamp.

Figure 7:
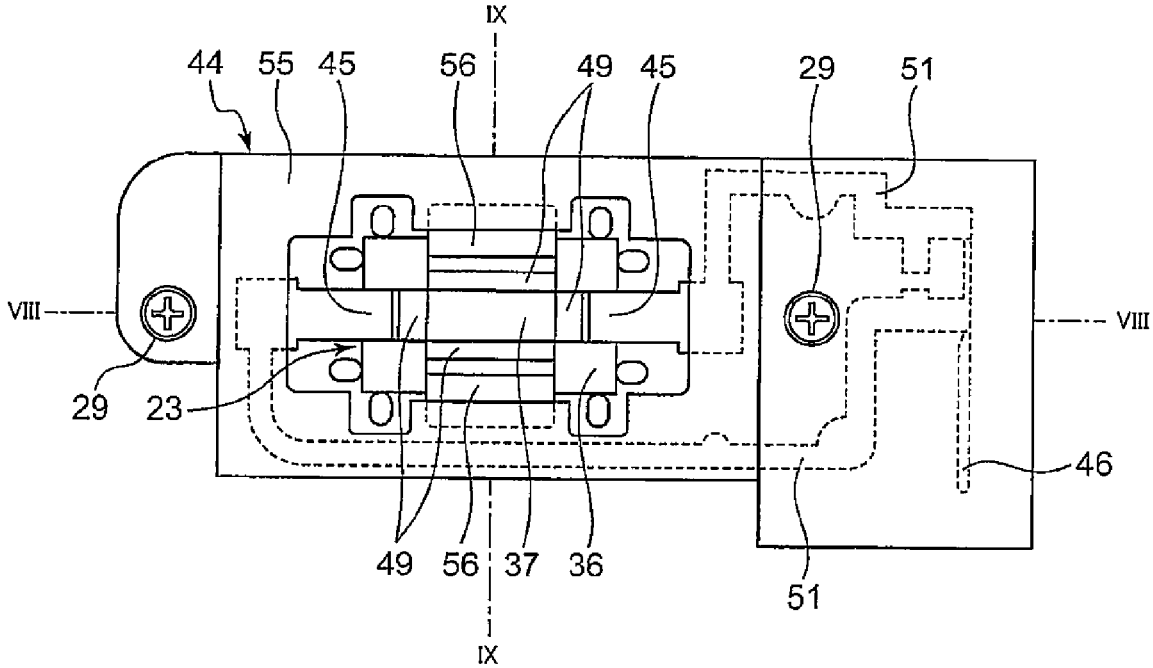
FIG. 7 is a plan view of main parts of a vehicle lamp according to yet another exemplary embodiment of the invention.
Figure 8:
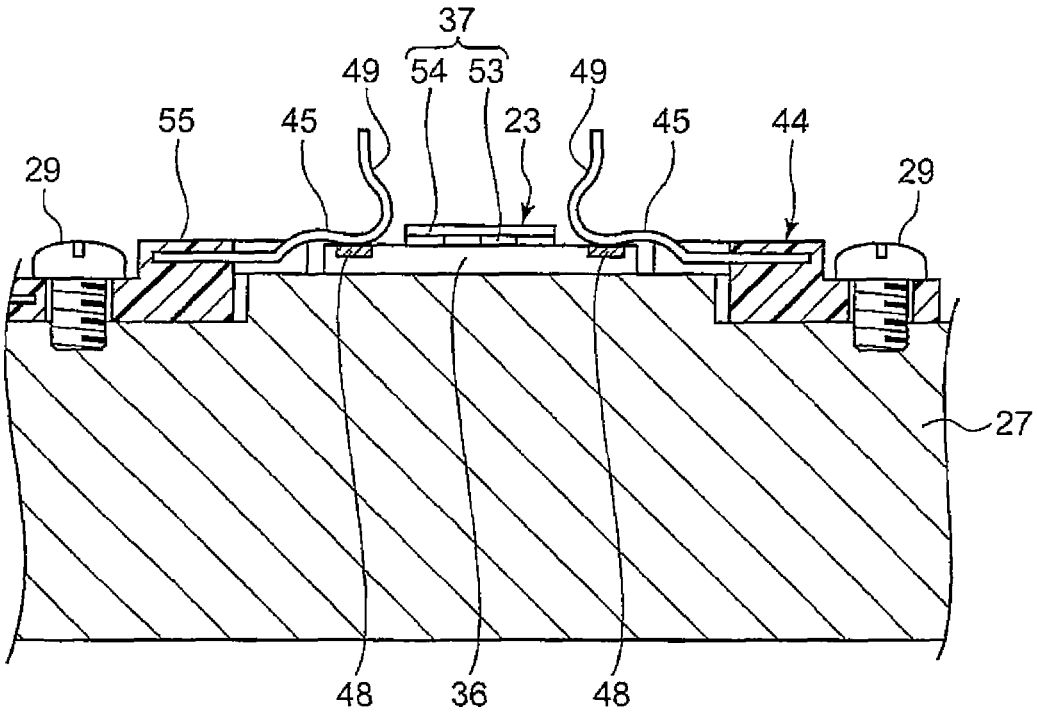
FIG. 8 is a cross-sectional view of the vehicle lamp shown in FIG. 7 taken along line VIII-VIII.
Figure 9:
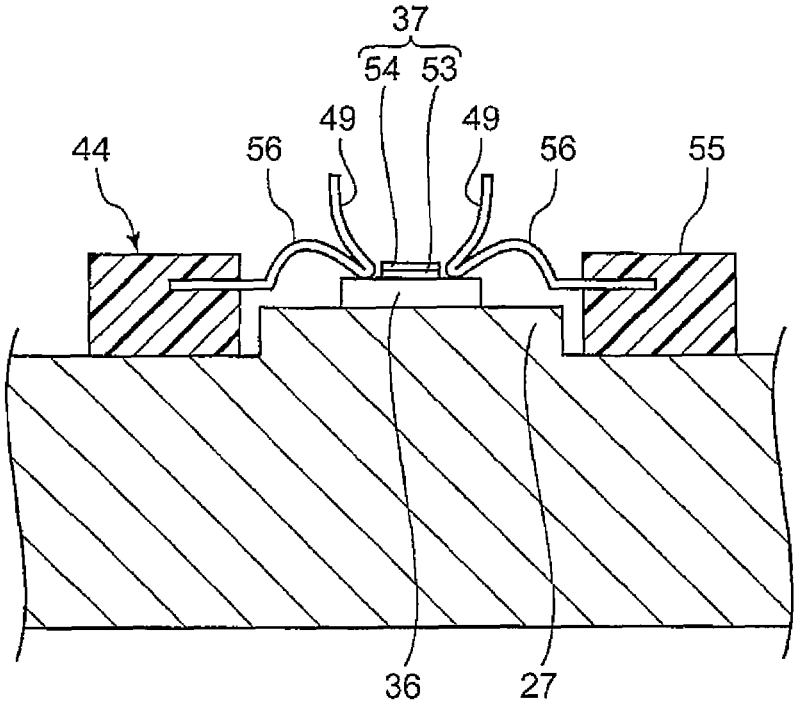
FIG. 9 is a cross-sectional view of the vehicle lamp shown in FIG. 7 taken along line IX-IX.

FIG. 7 is a plan view of main parts of a vehicle lamp according to yet another exemplary embodiment of the invention. Further, FIG. 8 is a cross-sectional view of the vehicle lamp shown in FIG. 7 taken along line VIII-VIII. Furthermore, FIG. 9 is a cross-sectional view of the vehicle lamp shown in FIG. 7 taken along line IX-IX. FIGS. 7 to 9 show the peripheral portion of an attachment 44. The attachment 44 according to this exemplary embodiment may be replaced by the attachment of the vehicle lamp shown in FIG. 1.

As shown in FIGS. 7 to 9, an LED package 23 is mounted on an LED mounting portion 27. The LED package 23 includes four blue LED chips 53 that are arranged in a line on the LED board 36, and a phosphor layer 54 that is provided on the light emitting surfaces of the blue LED chips 53. Sheet electrodes 48 provided on the LED board 36 are pressed by spring terminals 45 made of metal and both end portions of the LED board 36 in the width direction of the LED board are pressed by fixing spring terminals 56 made of metal, so that the LED package 23 is fixed on the LED mounting portion 27. Metal plates are subjected to pressing after insert molding, so that the spring terminals 45, the fixing spring terminals 56, conductive parts 51, and a connector terminal 46 are formed integrally with each other.

Moreover, reflectors 49, which reflect light emitted from an LED 37 so as to direct the light to a projection lens (not shown: see FIG. 1), are provided above the LED package 23. In this embodiment, the reflectors 49 are formed of metal plates.

Here, in this exemplary embodiment, the spring terminals 45, the fixing spring terminals 56, and the reflectors 49 are integrally formed of metal plates. More specifically, the end portions of the spring terminals 45 and the fixing spring terminals 56 extend, so that the reflectors are formed. The spring terminals 45 and the fixing spring terminals 56 are supported by a base portion 55 of the attachment 44.

As described above, in this exemplary embodiment, the attachment, the power supply unit, and the reflectors 49 are formed integrally with each other. Accordingly, since it is possible to reduce the number of components, it is possible to obtain an inexpensive vehicle lamp.

The invention has been described above with reference to the exemplary embodiments. It will be understood by those skilled in the art that the combination of the respective elements or respective processes may have various modifications and the modifications are also included in the scope of the invention.

For example, in the above-mentioned exemplary embodiments, the projection lens has been exemplified as an optical member that controls light emitted from the reflector so as to emit the light forward. However, the optical member is not limited thereto, and may be, for example, a reflector or the like.

What is claimed is:

1. A vehicle lamp comprising:

a light emitting diode (LED) mount on which an LED is placed;

an attachment that fixes the LED to the LED mount;

a power supply that supplies power to the LED;

a first optical member that controls light emitted from the LED; and a second optical member that controls light emitted from the first optical member, wherein the power supply and the first optical member are provided at the attachment, and the attachment includes a pushing member that pushes the LED against the LED mount.

2. The vehicle lamp according to claim 1, wherein the first optical member is a reflector that reflects light emitted from the LED so as to direct the light to the second optical member, and the reflector and the attachment are molded integrally with each other as a single piece.

3. The vehicle lamp according to claim 2, further comprising:

a shade that blocks a part of light from the reflector, wherein the reflector, the attachment, and the shade are molded integrally with each other as a single piece.

4. The vehicle lamp according to claim 1, wherein the first optical member is a reflector that reflects light emitted from the LED so as to direct the light to the second optical member, and the power supply and the reflector are formed integrally with each other as a single piece.

5. The vehicle lamp according to claim 1, wherein the first optical member is a reflector that reflects light emitted from the LED so as to direct the light to the second optical member, and the pushing member and the reflector are formed integrally with each other as a single piece.

6. The vehicle lamp according to claim 3, wherein the second optical member is a lens, and the reflector, the attachment, the shade, and a lens support, which supports the lens, are molded integrally with each other as a single piece.

7. The vehicle lamp according to claim 4, wherein the second optical member is a lens, and the power supply, the reflector, and a lens support, which supports the lens, are molded integrally with each other as a single piece.

8. A vehicle lamp comprising:

a light emitting diode (LED) mount on which an LED is placed;

an attachment that fixes the LED to the LED mount;

a power supply that supplies power to the LED;

a first optical member that controls light emitted from the LED; and a second optical member that controls light emitted from the first optical member, wherein the power supply and the first optical member are provided at the attachment, and wherein the power supply includes at least one spring terminal provided on the attachment.

9. The vehicle lamp according to claim 8, wherein the at least one spring terminal electrically connects to the LED.

10. The vehicle lamp according to claim 1, wherein the attachment comprises a resin-molded component that is molded in an L-shape.

* * * * *